United States Patent [19]

Hickman

[11] Patent Number: 4,878,044

[45] Date of Patent: Oct. 31, 1989

[54] GLAZING UNIT ALARM SYSTEM

[76] Inventor: James A. A. Hickman, 14a Seaforth Drive, Edinburgh, Scotland

[21] Appl. No.: 163,509

[22] Filed: Feb. 19, 1988

[30] Foreign Application Priority Data

Feb. 19, 1987 [GB] United Kingdom ..... 8703887

[51] Int. Cl.[4] ..... G08B 13/00

[52] U.S. Cl. ..... 340/550; 200/61.08

[58] Field of Search ..... 340/550, 590, 598; 200/61.08, DIG. 12; 52/171

[56] References Cited

U.S. PATENT DOCUMENTS 3,594,770 7/1971 Ham ..... 340/550

4,692,744 9/1987 Hickman ..... 200/61.08

FOREIGN PATENT DOCUMENTS 1596300 8/1981 United Kingdom ..... 340/550

2169426 9/1986 United Kingdom ..... 340/550

*Primary Examiner*—Joseph A. Orsino, Sr.

*Assistant Examiner*—Thomas J. Mullen, Jr.

*Attorney, Agent, or Firm*—Michael J. Striker

[57] ABSTRACT

A glazing unit alarm system comprising a glazing unit having at least one glazing panel and provided with spaced apart first and second faces and electric alarm means. The electric alarm means comprises a light transmitting electrically conductive coating on the first face and conducting breakable means on the second face. The alarm means are connected in series with the electrically conductive coating and the conducting means to respond to changes in resistance occasioned by a breakage or an attempted breakage of the glazing unit.

12 Claims, 2 Drawing Sheets

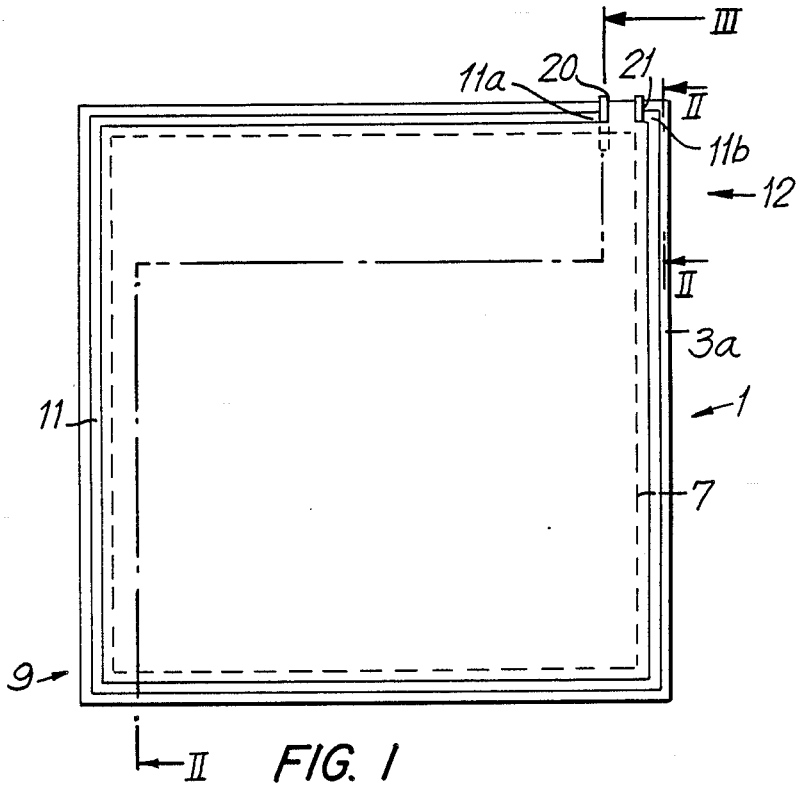
FIG. 1
FIG. 3
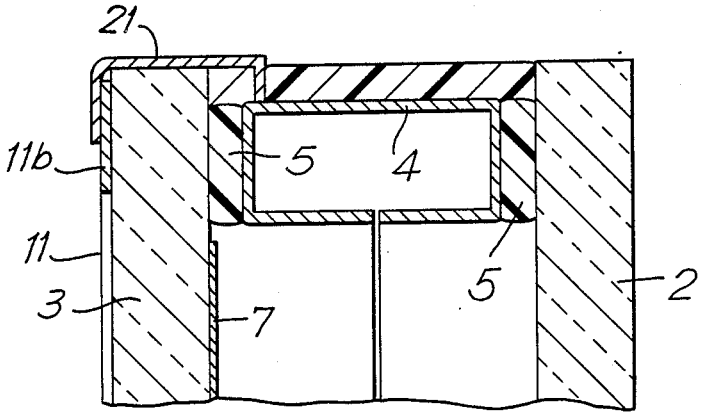

GLAZING UNIT ALARM SYSTEM

BACKGROUND OF THE INVENTION

1. Field of the Invention

This invention relates to a glazing unit alarm system of the kind comprising electric alarm means and a glazing unit incorporating at least one glazing panel having spaced apart faces, the alarm means including electrically conductive means applied to said at least one glazing panel and comprising a light transmitting electrically conductive coating extending across a first face of said at least one glazing panel and detecting means for detecting a change in resistance of the electrically conductive means occasioned by a breakage or an attempted breakage of the glazing unit. The invention is primarily, although not exclusively, intended for application in double glazing units.

2. Description of Related Art

A known glazing unit alarm system of the kind referred to is disclosed in GB-A-2,169,426. In this known alarm system the electrically conductive coating is in the form of an emissivity or solar control coating and serves the dual function of acting as a heat radiation filter with a cut off in the infra red region of the electromagnetic spectrum and as a part of the electric circuit of the electric alarm means. The cut off is suitably operative at a wavelength of from 2 μm to 10 μm, e.g. about 3 μm, and the coating transmits the majority of heat radiation incident thereon which has a wavelength on one side of the cut off wavelength and reflects the majority of heat radiation incident thereon which has a wavelength on the other side of the cut off wavelength. Normally the coating acts to transmit the majority of solar heat radiation and reflects the majority of the longer wavelength heat radiation produced in buildings by lights, radiations, absorbed and re-radiated solar energy and body heat.

SUMMARY OF THE INVENTION

The present invention seeks to provide a glazing unit alarm system of the kind referred to having a backup alarm.

According to the present invention a glazing unit alarm system of the kind referred to it characterized in that the electrically conductive means further comprises conducting means applied to a second face of said at least one glazing panel.

A glazing unit alarm system according to the invention has conductor elements applied on two spaced apart faces of the glazing panel(s). Changes in the resistance of either or both conductor element(s) occasioned by an attempted breakage of the glazing panel can be detected by the detecting means, thereby providing a back-up or double security alarm system.

Preferably the conducting means is applied in strip form around the periphery of said second face. In this way the conducting means will normally be hidden from view when the glazing panel is fixed in a window frame and hence need not be in the form of a transparent electrically conducting coating. It should be mentioned that there are many ways in which the conducting means may be applied to said second face. For example the conducting means may comprise a conductive paint or carbon based materials which can be applied by brush or spray, adhesive granules, e.g. of silver and/or copper, which can be blasted onto the glazing panel with compressed air, metallic tape or strip adhered to the glazing panel, or may be formed from an electric arc metallic spray. The main criterion for the conducting means is that it should undergo a change of resistance if the glazing panel to which it is applied is fractured. Normally the conducting means itself will be fractured so that, in effect, the resistance becomes very high.

The light transmitting electrically conductive coating applied to said first face and the conducting means may be connected in series or in parallel, although a series connection is preferred.

Preferably the glazing unit comprises a multiple, e.g. double, glazed unit having two or more glazing panels. In this case, said first and second faces preferably comprise the opposite faces of one of the glazing panels of the multiple, e.g. double, glazed unit. However it is also possible in an alternative construction for the first and second faces to comprise the faces of two different glazing panels of the multiple glazed unit.

The glazing unit may alternatively comprise a laminated glazing unit comprising two or more glazing panels laminated together. In this case the first and second faces may comprise inner surfaces, outer surfaces or an inner surface and outer surface of the glazing panels of the glazing unit. It will be appreciated that in a laminated glazing unit, the first and second faces may form one or two internal faces which are not apparent as "faces" in the finished laminated unit which typically has the appearance of a single glazing sheet.

BRIEF DESCRIPTION OF THE DRAWINGS

An embodiment of the invention will now be described, by way of example, with reference to the accompanying drawings, in which:

FIG. 1 is a schematic front view of a double glazing unit and an alarm circuit according to the invention;

FIG. 3 is a sectional side view taken on the line III—III of FIG. 1, showing on an enlarged scale an upper part of the double glazing unit.

DESCRIPTION OF THE PREFERRED EMBODIMENTS

Figure 2:
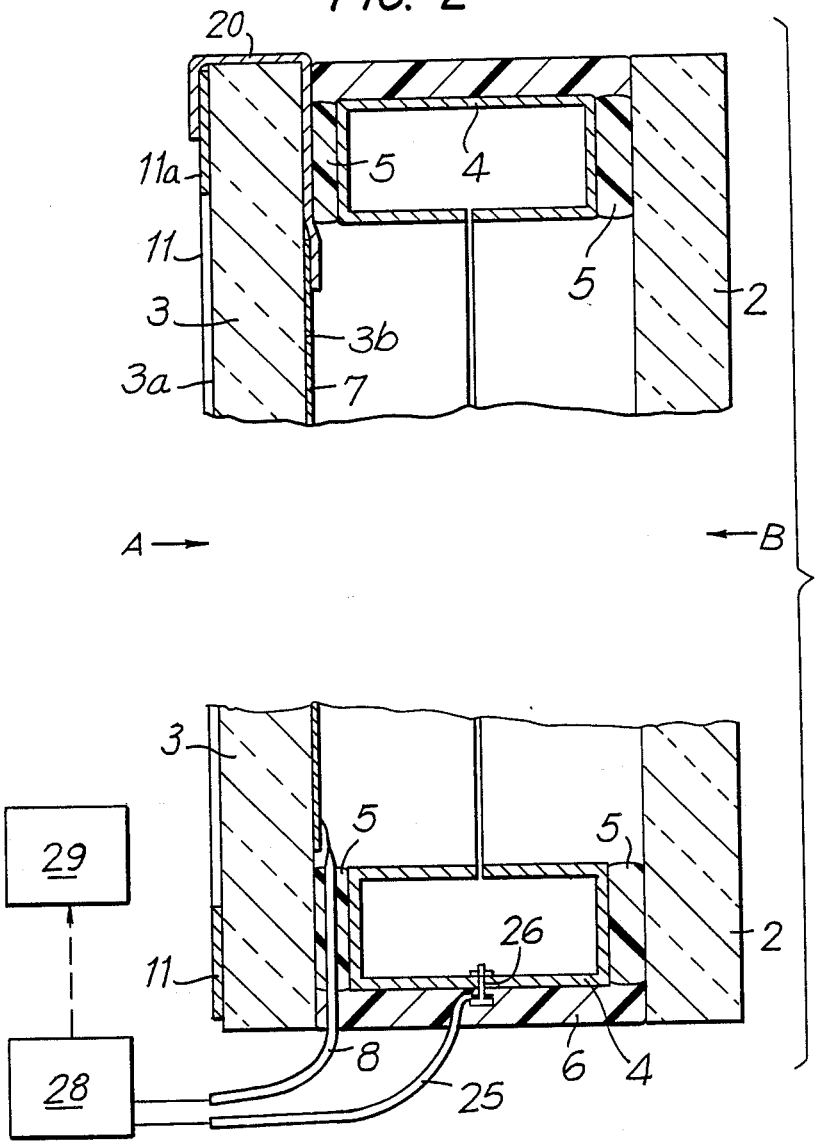
FIG. 2 is a sectional side view taken on the line II—II of FIG. 1, showing on an enlarged scale upper and lower parts of the double glazing unit in connection with an alarm system.

The drawings show a double glazing unit, generally designated 1, comprising glazing panels 2 and 3 arranged in face-to-face relationship and having peripheral spacing means 4 therebetween to space the panels 2 and 3 the desired distance apart. The spacing means 4 is conveniently in the form of a metallic electrically conducting, rectangular frame typically formed of hollow spacer elements containing a dessicant. Primary seals 5 (see FIG. 2), e.g. of polyisobutylene, are arranged between the spacing means 4 and the glazing panels 2 and 3 and a conventional secondary seal 6, e.g. of silicone, is provided around the entire periphery of the spacing means 4.

The glazing panel 2 may be of any known glazing material but is typically made of glass and may be clear, tinted and/or figured. The glazing panel 3 has on its inner face 3b a light transmitting, electrically conductive coating 7 applied on its inner face. The coating 7 may be of any type, but the invention is primarily concerned with coatings known as solar control or emissivity coatings. In particular the coating 7, in the embodiment described, is of the emissivity type which serves to allow the majority of the short wavelength solar radiation incident thereon to pass through the glazing unit 1 in the direction indicated by the arrow A in FIG. 2 but to reflect the majority of the longer wavelength room heat incident on the glazing unit as indicated by the arrow B. "Energy glass" having such emissivity coatings is readily available in the United Kingdom, for example under the Trade Names of "KAPPAFLOAT" (Pilkington Brothers Ltd.) or "IPLUS" (Interpanel Glas AG).

In the glazing unit 1 a part of the emissivity coating 7 has been removed, e.g. by burning off or grinding, around the entire periphery of the glazing panel 3 to a distance of approximately 12 mm—i.e. just inwardly of the spacing means 4—and an electrical wire 8, e.g. a copper wire, (see FIG. 2) is electrically connected to a corner region 9 of the coating 7.

On the outer face 3*a* of the glazing panel 3 there is arranged an easily fracturable strip 11 of conductive material which extends around the periphery of the panel 3. The strip 11 is not continuous, there being a break or discontinuity in corner region 12 of the panel 3 diagonally opposite the corner region 9 so that the strip has a pair of ends 11*a* and 11*b*. The strip 11 may be applied in any convenient manner, e.g. as a tape or brushed or sprayed on as an electrically conducting paint. The strip 11 may or may not be transparent.

An electrically conductive "tail" or web 20 is provided around the rim of the panel 3 to electrically connect the part of the coating 7 adjacent the corner region 12 with the end 11*a* of the strip 11. A further electrically conductive "tail" or web 21 is provided around the rim of the panel 3 to electrically connect the end 11*b* of the strip 11 to the electrically conducting spacing means 4, as shown in FIG. 3. An electrical wire 25, e.g. a copper wire, is mechanically and electrically connected to the spacer means 4 by screw attachment means 26 adjacent the corner region 9. The wires 8 and 25 are connected to an alarm box 28. An electrically conductive series connection is therefore provided by the wire 8 the coating 7 (from corner region 9 to corner region 12) the conductive web 20 the strip 11, the conductive web 21, the conducting spacing means 4 and the wire 25. This series connection is connected into and forms part of an alarm circuit of the alarm box 28.

Any type of alarm circuit may be employed in the alarm box 28. The alarm circuit may be powered by a small, replaceable domestic battery, e.g. a 9V battery which, in typical applications, may have a lie in excess of 12 months. Alternatively the alarm box may be plugged into a mains circuit. The alarm box 28 may also incorporate a transmitter for transmitting an alarm signal to a receiving unit 29 situated at a remote location from the alarm box. Conveniently the alarm circuit is arranged to be activated when there is a breakage in the conduction path between the conductors 8 and 25 in the aforementioned series connection occasioned by breakage or removal of the glazing panel 3. The alarm circit may, however, be more complex to enable the sensing of sudden changes in the resistance of the metallic coating 7 and/or the strip 11 occasioned by the glazing panel 3 being put under strain and/or being partly broken.

By way of example, a block diagram of a typical alarm circuit for use in the alarm system is shown in FIG. 8 of GB-A-2169426. In the illustrated circuit a resistance bridge 40 is provided for detecting changes in the series resistance (represented by the resistance 41) of the coating 7 and the strip 11. A power supply 42, e.g. a d.c. power supply, supplies power to the bridge. Signals from the bridge 40 are supplied via an amplifier 43 to a threshold detector 44. If the null balance of the bridge 40 is outside a predetermined limit the threshold detector 44 supplies a signal to alarm 45. The alarm circuit may also include a circuit 46 for checking the charge of the battery and sounding the alarm 45, e.g. intermittently over a long period, when it needs to be replaced.

A resistance bridge is not, of course, the only way of detecting a change in the resistance of the emissivity coating. FIG. 9 of GB-A-2169426 shows another simple technique employing an operational amplifier 50 having a resistor 51 connected to its input and a further resistor 52 connected across the amplifier. Since the output voltage from the operational amplifier 50 is dependent on the resistances of the resistors 51 and 52, the circuit can be used as a resistance detector if one of the resistors 51, 52 comprises the series connection of the coating 7 and strip 11.

The alarm system described herein provides a sophisticated alarm in which two conductive paths are provided on different faces of at least one glazing panel. If either conductive path is broken the alarm circuitry is designed to detect such a breakage. Even if one of the conductive paths is bridged, fracture of the other conductive path will operate the alarm.

The coating 7 need not, of course, be an emissivity coating, although this is preferred. Furthermore the conductive material applied to the "second face" need not be of "strip" form. Indeed this conductive material could also be a transparent or light tranmsitting electrically conductive layer.

I claim:

1. A glazing unit alarm system comprising a glazing unit incorporating at least one glazing panel having spaced apart first and second faces, and electric alarm means responsive to a change in resistance, comprising a series connection of a light transmitting electrically conductive coating extending across a major part of the area of said first face of said at least one glazing panel, an electrically conducting strip applied to said second face, an electrically conductive web for connecting one end portion of said strip to said conductive coating, and electrical conductor means for connecting respectively, the other end portion of said strip and said conductive coating to said electric alarm means.

2. An alarm system according to claim 1 in which the said strip is applied around the periphery of said second face and the end portions of said strip being spaced a small distance one from the other.

3. An alarm system according to claim 2, in which the said strip is sprayed on to the said second face.

4. An alarm system according to claim 2, in which the said strip is a metallic strip adhered to the said second face.

5. An alarm system according to claim 1, in which the glazing unit comprises a multiple, e.g. double, glazed unit having at least two spaced apart glazing panels, the said first and second faces comprising opposite faces of one of the glazing panels of the multiple glazed unit.

6. An alarm system according to claim 5 wherein said panels are spaced apart by peripheral spacing means of electrically conductive material, said electrical conductor means including another web for connecting the other end portion of said strip to said spacing means and two conductors for connecting, respectively, said spacing means and said conductive coating to said alarm means.

7. An alarm system according to claim 6 wherein said webs are turned over the rim of said one glazing panel.

8. An alarm system according to claim 1, in which the glazing unit comprises a multiple, glazing unit having at least two spaced apart glazing panels, said first and second faces comprising faces of two different glazing panels of the multiple glazed unit.

9. A glazing unit alarm system comprising a glazing unit incorporating at least one glazing panel having spaced apart first and second faces and electric alarm means including electrically conductive means applied to said at least one glazing panel and comprising a light transmitting electrically conductive coating extending over at least most of the area of said first face of said at least one glazing panel and detecting means for detecting a change in resistance of the electrically conductive means occasioned by a breakage or an attempted breakage of the glazing unit, wherein the electrically conductive means further comprises conducting means applied in strip form around the periphery of said second face of said at least one glazing panel.

10. An alarm system according to claim 9, in which the said conducting means is sprayed on to the said second face.

11. An alarm system according to claim 9, in which the said conducting means comprises metallic strip means adhered to the said second face.

12. An alarm system according to claim 9, in which the glazing unit comprises a multiple glazed unit having at least two glazing panels, the said first and second faces comprising opposite faces of one of the glazing panels of the multiple glazed unit.

* * * * *